US007635176B2

(12) United States Patent
Taira et al.

(10) Patent No.: US 7,635,176 B2
(45) Date of Patent: Dec. 22, 2009

(54) CONNECTION STRUCTURE BETWEEN RESIN COMPONENT AND METAL COMPONENT AND INK-JET HEAD COMPRISING THE SAME

(75) Inventors: Hiroshi Taira, Ichinomiya (JP); Yoshirou Kita, Nagoya (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 426 days.

(21) Appl. No.: 11/690,375

(22) Filed: Mar. 23, 2007

(65) Prior Publication Data

US 2007/0229576 A1 Oct. 4, 2007

(30) Foreign Application Priority Data

Mar. 31, 2006 (JP) ..... 2006-097261

(51) Int. Cl.
*B41J 2/015* (2006.01)

(52) U.S. Cl. ..... 347/20; 347/68; 347/49; 347/71

(58) Field of Classification Search ..... 347/20, 347/49, 50, 56–59, 68, 70–71
See application file for complete search history.

(56) References Cited

U.S. PATENT DOCUMENTS 5,456,719 A * 10/1995 Keller ..... 623/11.11
7,252,369 B2 8/2007 Nakamura et al.
2008/0049063 A1 2/2008 Nakamura et al.

FOREIGN PATENT DOCUMENTS

JP H06-207699 A 7/1994
JP 2001-027323 A 1/2001
JP 2003090308 A 3/2003
JP 2005-161761 A 6/2005

OTHER PUBLICATIONS

Japan Patent Office; Notice of Reasons for Rejection in Japanese Patent Application No. 2006-097261 (counterpart to the above-captioned U.S. patent application) mailed May 19, 2009.

* cited by examiner

*Primary Examiner*—Juanita D Stephens
(74) *Attorney, Agent, or Firm*—Baker Botts, LLP

(57) ABSTRACT

The first passage component and the second passage component are fixed with each other as the male screw part is screw-engaged with the female screw hole while the cylinder part is inserted into the through-hole. The second passage component has a convex contacting the head and a spaced surface spaced apart from the head in the axial direction, both in a first annular confronting area confronting the head of the stepped screw, at a surrounding of the through-hole of the third surface. The axial length of the cylinder part is same as the length of a line segment extending to the second surface from the leading end of the convex in the axial direction, while the axial length of the cylinder part is smaller than the length of the line segment until the male screw part is screw-engaged with the female screw hole.

8 Claims, 11 Drawing Sheets

CONNECTION STRUCTURE BETWEEN RESIN COMPONENT AND METAL COMPONENT AND INK-JET HEAD COMPRISING THE SAME

CROSS-REFERENCE TO RELATED APPLICATION

This application claims priority to and the benefit of Japanese Patent Application No. 2006-097261, which was filed on Mar. 31, 2006, the disclosure of which is incorporated herein by reference.

BACKGROUND OF THE PRESENT INVENTION

1. Field of the Present Invention

The present invention relates to a connection structure between a resin component and a metal component and an ink-jet head comprising the same.

2. Description of Related Art

A Japanese Patent Unexamined Publication No. 2003-90308 discloses a technology of connecting a resin component and a metal component with a stepped screw. The stepped screw has a head, a large diameter part connected to the head and a small diameter part extending from the leading end of the large diameter part, having a diameter smaller than the large diameter part and being threaded. The large diameter part is not threaded and has an approximately same length as a thickness of the resin component. According to the above document, the metal component has a female screw hole that is screw-engaged with the small diameter part of the stepped screw and the resin component has a through-hole that is engaged with the large diameter part of the stepped screw. A rubber pad is interposed between the head of the stepped screw and the resin component to conduct a screwing process. Therefore, stress applied to the resin component is relieved by the pad, so that it is possible to prevent a crack from occurring in the resin component.

SUMMARY OF THE PRESENT INVENTION

According to the above prior art, the screwing process is conducted while interposing the pad, so that the stress concentration on the resin component can be relieved. However, when there occurs a difference of heat expansions between the components due to a change in environmental temperature when shipping a product, for example, a thickness is reduced and disengagement thus occurs at a part of the resin component with which the stepped screw is engaged, so that the two components are not fixed to each other. When such problem occurs in a connection structure of an ink-jet head, ink is leaked from the connection part, so that it becomes difficult to supply the ink to nozzles smoothly.

An object of the present invention is to provide a connection structure between a resin component and a metal component capable of maintaining fixation between the components even when there occurs a change in environmental temperature, and an ink-jet head comprising the same.

According to a first aspect of the present invention, there is provided an ink-jet head including a first passage component, a second passage component, and a screw. The first passage component has an ink ejection face and a first surface. In the ink ejection face, ink ejection ports for ejecting ink are formed. The first surface is opposite to the ink ejection face and is composed of metal. The second passage component is composed of resin and has a second surface and a third face. The second face contacts the first surface of the first passage component. The third surface is opposite to the second surface. The second surface has an outlet through which the ink to be supplied to the first passage component is discharged. The screw fixes the first passage component and the second passage component each other. The second passage component is formed with a through-hole connecting the second surface and the third surface. The first surface of the first passage component is formed with a female screw hole smaller in diameter than the through-hole and an inlet into which the ink discharged through the outlet is introduced. The screw is a stepped screw having a head, a cylinder part and a male screw part. The head is larger in diameter than that of the through-hole. The cylinder part is connected to the head and has a diameter capable of being inserted into the through-hole. The male screw part extends from the leading end of the cylinder part in the axial direction of the cylinder part and has a diameter smaller than the through-hole. The first passage component and the second passage component are fixed with each other as the male screw part is screw-engaged with the female screw hole while the cylinder part of the stepped screw is inserted into the through-hole. The second passage component has a convex contacting the head and a spaced surface spaced apart from the head in the axial direction, both in a first annular confronting area confronting the head of the stepped screw, with respect to the axial direction, at a surrounding of the through-hole of the third surface. The axial length of the cylinder part is same as the length of a line segment extending to the second surface from the leading end of the convex in the axial direction, while the axial length of the cylinder part is smaller than the length of the line segment until the male screw part is screw-engaged with the female screw hole.

In the first aspect of the invention, during the screwing process of the stepped screw, the convex of the second passage component is pressed and deformed at the head of the stepped screw. When the leading end of the cylinder part of the stepped screw is press-contacted to the first surface of the first passage component, the screwing of the stepped screw is terminated. At this time, the force is applied to the head of the stepped screw from the deformed convex, in a direction opposite to the screwing direction, and reaction to the force is applied to the convex from the head of the stepped screw. By the action-reaction of the force, the stepped screw is securely fixed to the first and second passage components, so that it is possible to maintain the state at the time of the screwing termination. In other words, the first and second passage components are firmly fixed without being dislocated from each other, thereby maintaining the fixed state. In such structure, even when there occurs a change in environmental temperature, it does not influence on the fixed state of the stepped screw, so that it is possible to maintain the fixation between the components.

Furthermore, the fixation between the first passage component and the second passage component is firmly maintained even when there occurs a change in environmental temperature, so that the problem that the ink is leaked from the connected part between the first passage component and the second passage component is reduced. As a result, it is possible to supply the ink to the ink ejection ports smoothly.

According to a second aspect of the present invention, there is provided a connection structure between a resin component and a metal component using a screw. The metal component has a first surface contacting the resin component. The resin component has a second surface contacting the first surface of the metal component and a third surface opposite to the second surface. The resin component is formed with a through-hole connecting the second surface and the third surface. In the first surface of the metal component is formed with a female screw hole smaller in diameter than the through-hole. The screw is a stepped screw having a head, a cylinder part, and a male screw part. The head has a diameter larger than that of the through-hole. The cylinder part is connected to the head and has a diameter capable of being inserted into the through-hole. The male screw part extends from a leading end of the cylinder part in the axial direction of the cylinder part and has a diameter smaller than the through-hole. The resin component and the metal component are fixed with each other as the male screw part is screw-engaged with the female screw hole while the cylinder part of the stepped screw is inserted into the through-hole. The resin component has a convex contacting the head and a spaced surface spaced apart from the head in the axial direction, both in an annular confronting area confronting the head of the stepped screw, with respect to the axial direction, at a surrounding of the through-hole of the third surface. The axial length of the cylinder part is same as the length of a line segment extending to the second surface from a leading end of the convex in the axial direction, while the axial length of the cylinder part is smaller than the length of the line segment until the male screw part is screw-engaged with the female screw hole.

In the second aspect of the invention, during the screwing process of the stepped screw, the convex of the resin component is pressed and deformed at the head of the stepped screw. When the leading end of the cylinder part of the stepped screw is press-contacted to the first inner surface of the metal component, the screwing of the stepped screw is terminated. At this time, the force is applied to the head of the stepped screw from the deformed convex, in a direction opposite to the screwing direction, and reaction to the force is applied to the convex from the head of the stepped screw. By the action-reaction of the force, the stepped screw is securely fixed to the resin component and the metal component, so that it is possible to maintain the state at the time of the screwing termination. In other words, the resin component and the metal component are firmly fixed without being dislocated from each other, thereby maintaining the fixed state. In such structure, even when there occurs a change in environmental temperature, the disengagement of the screw is suppressed, so that it is possible to maintain the fixation between the components.

BRIEF DESCRIPTION OF THE DRAWIGNS

Other and further objects, features and advantages of the present invention will appear more fully from the following description taken in connection with the accompanying drawings in which.

DESCRIPTION OF THE PREFERRED EMBODIMENTS

Hereinafter, preferred embodiments of the present invention will be described with reference to the accompanying drawings.

Figure 1:
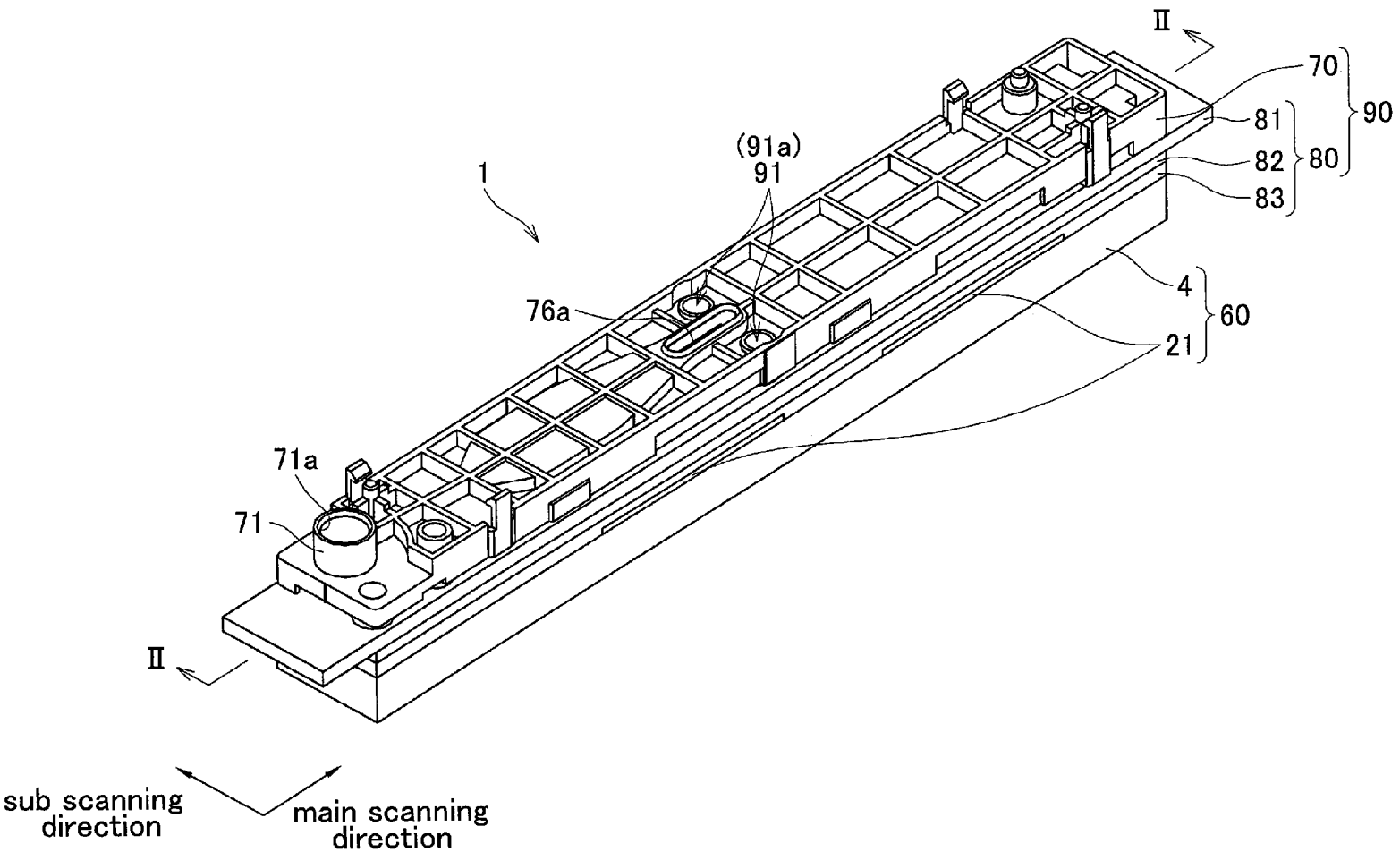
FIG. 1 is a perspective view of an ink-jet head according to an embodiment of the present invention.

An ink-jet head 1 according to an embodiment of the present invention shown in FIG. 1 has an elongated shape in a main scanning direction and includes a head main body 60 and a reservoir unit 90 from bottom. The head main body 60 includes a passage unit 4 having an ink ejection face 30*a* (refer to FIG. 10) on a lower surface thereof and four actuator units 21 (refer to FIG. 8) attached to an upper surface of the passage unit 4. The reservoir unit 90 includes, from top, a filter component 70 made of resin, i.e. a second passage component or a resin component, and an ink distribution component 80 made of metal. The filter component 70 and the ink distribution component 80 are fixed to each other by stepped screws 91. The connection structure will be specifically described later.

The filter component 70 is manufactured by a unity molding using resin and has a cylindrical protrusion 71 on a longitudinal end of an upper surface 70*f* (refer to FIG. 2) thereof, that is a third surface. The cylindrical protrusion 71 has an introducing port 71*a* formed therein. To the cylindrical protrusion 71 is attached a tube and a valve. Ink from an ink source such as ink tank is introduced in the filter component 70 through the introducing port 71*a*.

Figure 2:
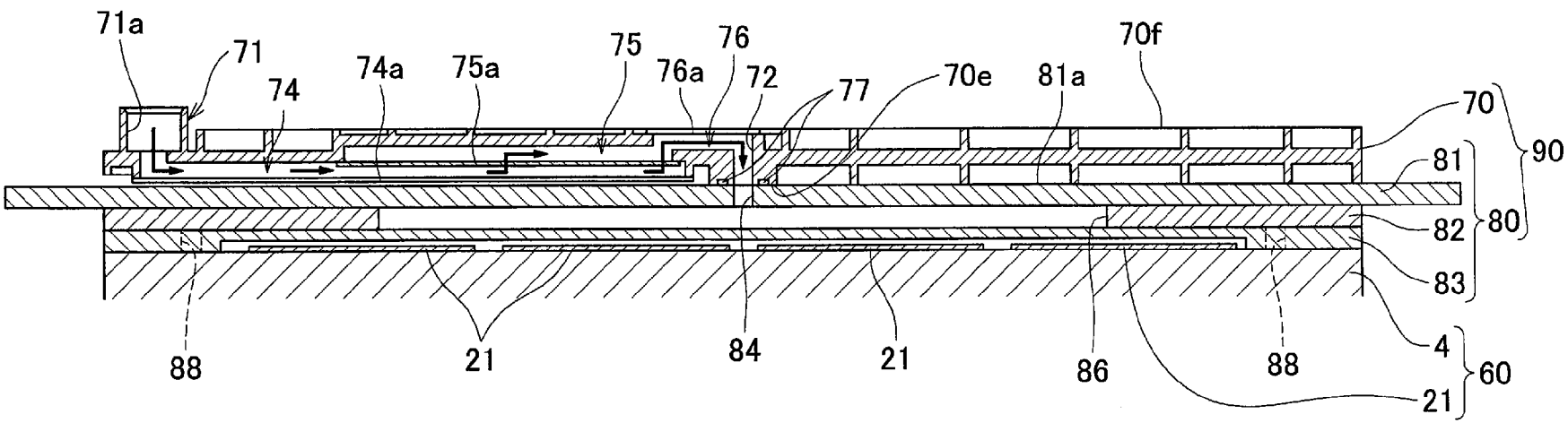
FIG. 2 is a sectional view taken along a line II-II of FIG. 1.

As shown in FIG. 2, in the filter component 70, an ink passage is formed from the introducing port 71*a* to an outlet 72. The ink introduced from the introducing port 71*a* is first introduced into a first hole 74. The first hole 74 has a same shape as a damper film 74*a* (refer to FIG. 3) in plan view and a lower end of the first hole 74 is shielded by the damper film 74*a*. The damper film 74*a* absorbs vibration that occurs when the ink is introduced from the introducing port 71*a*. The ink introduced to the first hole 74 is introduced into a second hole 75 through a filter 75*a*. Furthermore, the ink passes to a space 76 having a damper film 76*a* formed at an upper end thereof, then flows downward and is discharged to the ink distribution component 80 from the outlet 72 formed so that it is opened into a lower surface 70*e*, i.e. a second surface.

Herein, it is described a connection structure between the filter component 70 and the ink distribution component 80 using the stepped screws 91.

Figure 3A:
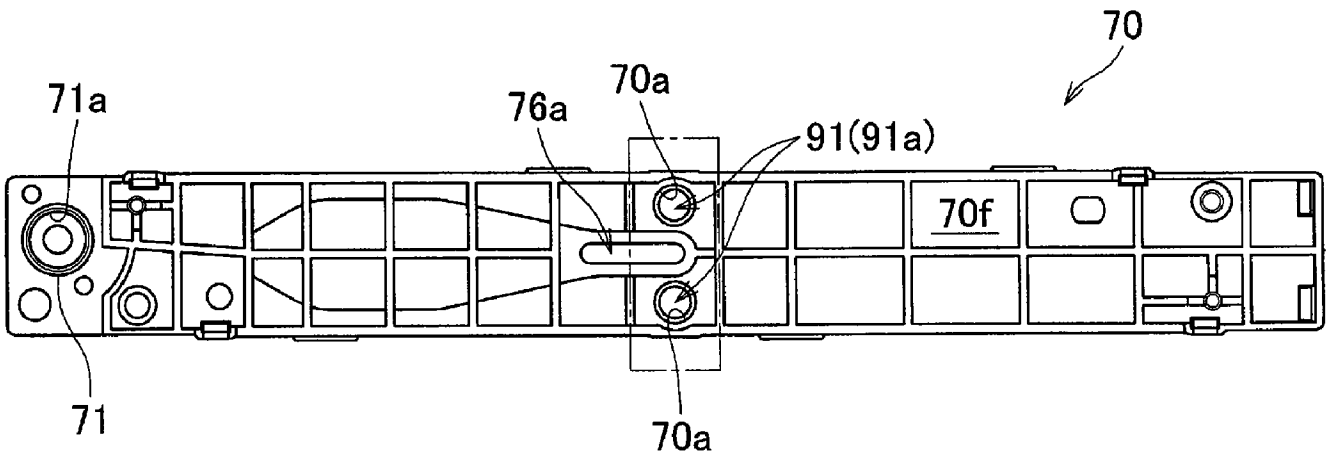
FIG. 3A is a plan view of a filter component of a reservoir unit included in the ink-jet head of FIG. 1.
Figure 3B:
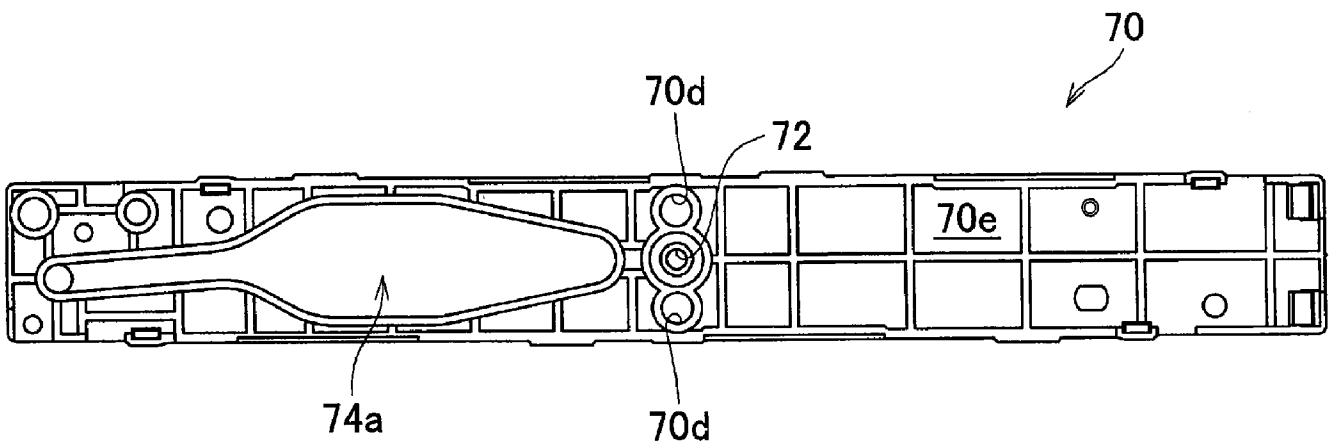
FIG. 3B is a bottom view of a filter component.
Figure 4:
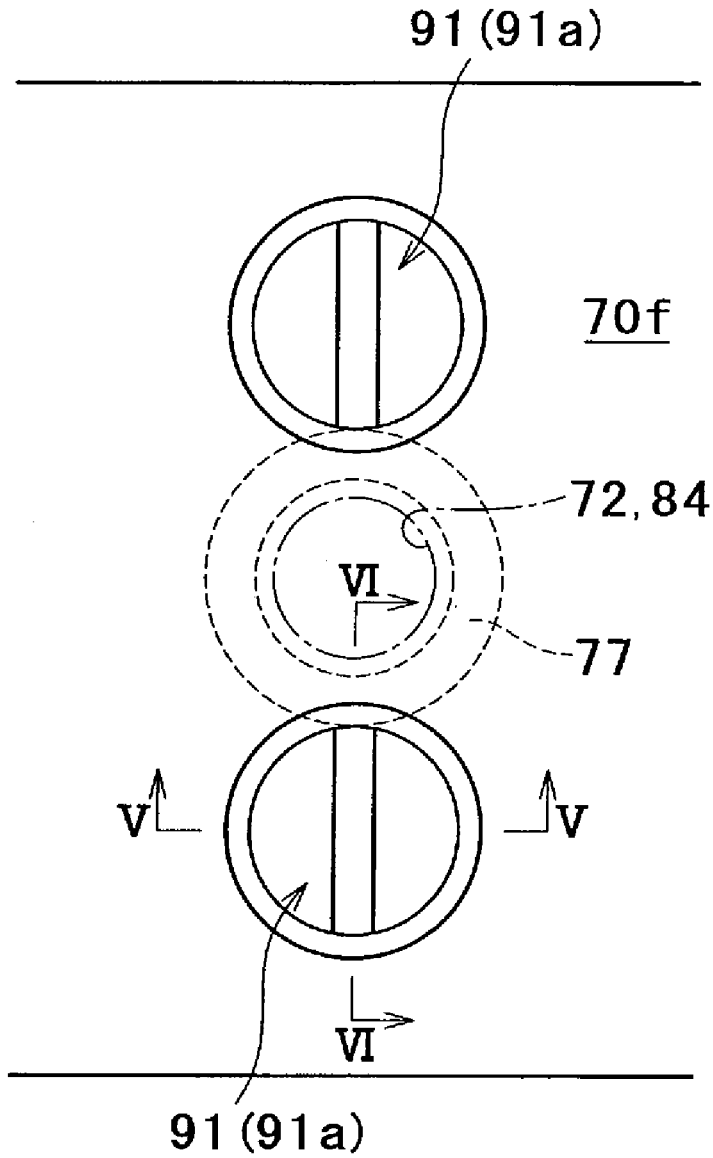
FIG. 4 is an enlarged view of a part surrounded by a dashed dotted line of FIG. 3A.

As shown in FIG. 3A, on the upper surface 70*f* of the filter component 70, recesses 70*a* are formed at both sides of the outlet 72 with respect to a sub scanning direction (refer to FIG. 1). Bottom surfaces of the respective recesses 70*a* are formed with through-holes 70*d* perforated in a thickness direction of the filter component 70 so that they connect the lower surface 70*e* and the upper surface 70*f* of the filter component 70 (refer to FIGS. 5A and 5B). As shown in FIG. 4, the recesses 70*a* and the through-holes 70*d* are formed such that centers of the two stepped screws 91 are symmetrically disposed, in plan view, about central axes of the outlet 72 and an inlet 84 which will be described later. In this embodiment, the outlet 72 is formed at a center of the lower surface 70*e* of the filter component 70 and the two through-holes 70*d* are symmetrically formed for the corresponding outlet 72, with respect to the sub scanning direction. In addition, a pair of ribs is formed on the upper surface 70*f* of the filter component 70, which extend in parallel with each other in the sub scanning direction while interposing a row formed by the outlet 72 and the two through-holes 70*d*.

Figure 5A:
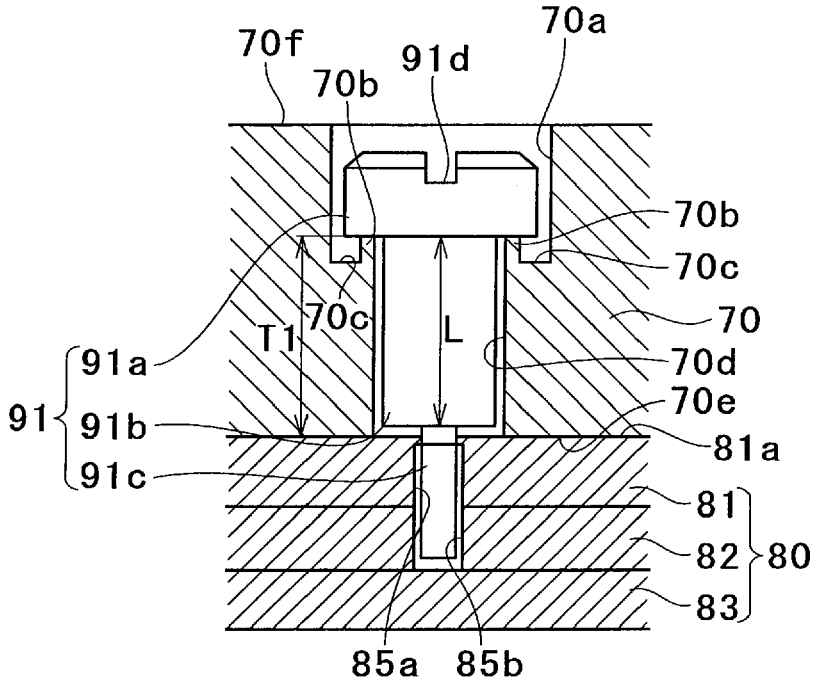
FIG. 5A is a sectional view taken along a line V-V of FIG. 4 before a screwing process by a stepped screw is terminated.
Figure 5B:
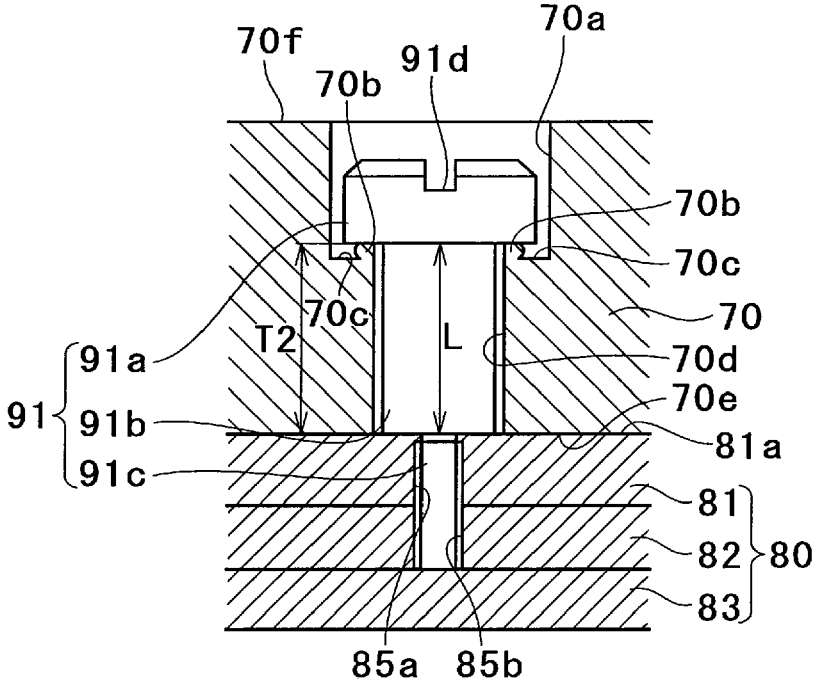
FIG. 5B is a sectional view taken along a line V-V of FIG. 4 when a screwing process by a stepped screw is terminated.
Figure 6:
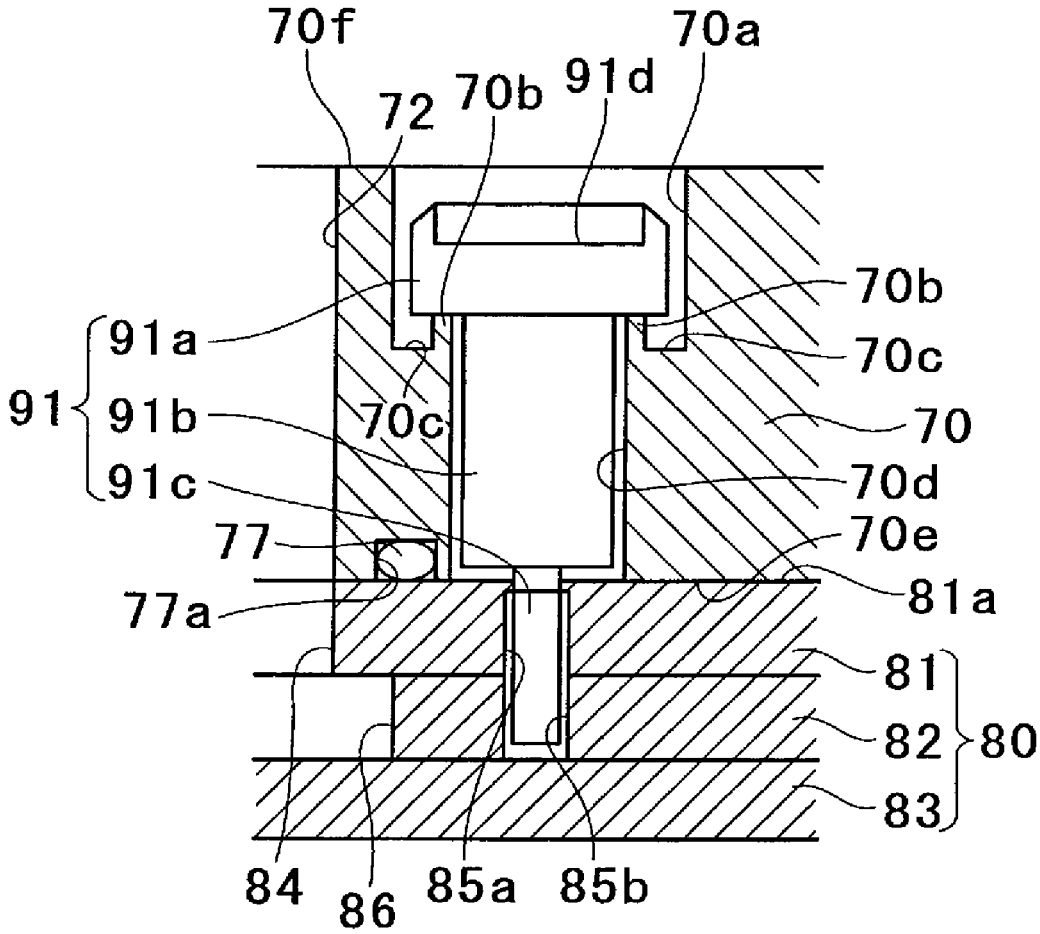
FIG. 6 is a sectional view taken along a line VI-VI of FIG. 4.

In the mean time, FIG. 4 is an enlarged view of a part surrounded by a dashed dotted line of FIG. 3A. FIG. 5 is a sectional view taken along a line V-V of FIG. 4 and shows a process of connecting the filter component 70 of resin and the ink distribution component 80 of metal with the stepped screws 81. FIG. 5A shows a state before a screwing process by the stepped screws 91 is terminated, and FIG. 5B shows a state when a screwing process by the stepped screws 91 is terminated, thereby fixing the filter component 70 and the ink distribution component 80 of metal each other. FIG. 6 is a sectional view taken along a line VI-VI of FIG. 4.

As shown in FIGS. 5A and 5B, each of the stepped screws 91 has a head 91*a* having a diameter larger than the through-hole 70*d*, a cylinder part 91*b* connected to the head 91*a* and having a diameter that is slightly smaller than the diameter of the through-hole 70*d* so that it can be inserted into the through-hole 70*d*, and a male screw part 91*c* extending from the leading end of the cylinder part 91*b* in the axial direction of the cylinder part 91*b* and having a diameter smaller than the through-hole 70*d*. A side face of the cylinder part 91*b* and an inner surface of the through-hole 90*d* are not threaded and a side face of the male screw part 91*c* and inner surfaces of first and second female screw holes 85*a*, 85*b* of the ink distribution component 80 are threaded so that they can be screw-engaged.

As shown in FIG. 5A, the bottom surfaces of the respective recesses 70*a* are formed with convexes 70*b* that protrude upward. The convexes 70*b* are annularly shaped along an edge of the through-hole 70*d* so that they contact the vicinity of the connected part of the head 91*a* and the cylinder part 91*b* of the stepped screw 91. Furthermore, in the bottom surface of the respective recesses 70*a*, convexes 70*b* and spaced surfaces 70*c* are formed in annual regions confronting the head 91*a* in the axial direction of the cylinder part 91*b*, i.e. in the vertical direction along the sheet of FIG. 5A. The region is the first confronting region. The convexes 70*b* contact the head 91*a*. The spaced surfaces 91*c* are apart from the head 91*a* in the axial direction.

When connecting the filter component 70 and the ink distribution component 80 with the stepped screws 91, the cylinder parts 91*b* of the respective stepped screws 91 are first inserted into the through-holes 70*d* and the male screw parts 91*c* are screw-engaged with the first and second female screw parts 85*a*, 85*b* of the ink distribution component 91*c*, as shown in FIG. 5A. In this step, the convexes 70*b* are not deformed by the pressing, as described later, and the length T1 of a line segment, which extends from the leading ends of the convexes 70*b* to the lower surface 70*e* of the filter component 70 in the axial direction of the cylinder part 91*b*, is larger than the axial length L of the cylinder part 91*b*. In addition, the male screw parts 91*c* are not completely screw-engaged with the female screw holes 85*a*, 85*b* and there is formed a gap between the leading end of the cylinder part 91*b*, to which the male screw part 91*c* is connected, and an upper surface 81*a* of an upper plate 81 which will be described below.

As a screwing process is proceeding by grooves 91*d* formed on the upper surfaces of the heads 91*a* with a screw-driver, the convexes 70*b* are deformed by the pressing force from the heads 91*a* and the stepped screws 91 are tightened into, as shown in FIG. 5B. Then, when the male screw parts 91*c* are completely screw-engaged with the female screw holes 85*a*, 85*b*, and the gaps between the leading ends of the cylinder parts 91*b* and the upper surface 81*a* of the upper plate 81 disappears and the corresponding leading ends and the upper surface 81*a* are thus press-contacted to each other, the screwing process of the stepped screws 91 is terminated. At this time, the length T2 of the line segment, which extends from the leading ends of the deformed convexes 70*b* to the lower surface 70*e* of the filter component 70 in the axial direction of the cylinder part 91*b*, is same as the axial length L of the cylinder part 91*b*.

In addition, as shown in FIGS. 2, 4 and 6, in the recesses 77*a* formed to surround the outlet 72 of the lower surface 70*e* of the filter component 70, O-rings 77 are disposed as elastic deformation components made of elastic material. The outlet 72 is formed to communicate with the inlet 84 formed on the upper surface of the upper plate 81 of the ink distribution component 80, and the connection part between the outlet 72 and the inlet 84 is surrounded by the O-rings 77 in a water-tight manner. As shown in FIG. 6, the O-rings 77 are interposed between a wall defining the bottom surfaces of the recesses 77*a* and the upper surface 81*a* of the upper plate 81, so that they are elastically deformed. The diameter of the O-ring 77 in an elastically returned state, i.e. original state, is larger than the depth of the recess 77*a*.

As shown in FIG. 4, the respective stepped screws 91 are symmetrically disposed, in plan view, with respect to the O-rings 77 and are also disposed so that the heads 91*a* are partially overlapped with the O-rings 77. As described above, a pair of ribs is formed on the upper surface 70*f* of the filter component 70, which extend in parallel with each other in the sub scanning direction while interposing a row formed by the outlet 72 and the two through-holes 70*d*. Accordingly, the rigidity near the parts to which the stepped screws 91 are attached is increased. As a result, the engagement force by the stepped screws 91 is equally applied to the O-rings 77.

Figure 7:
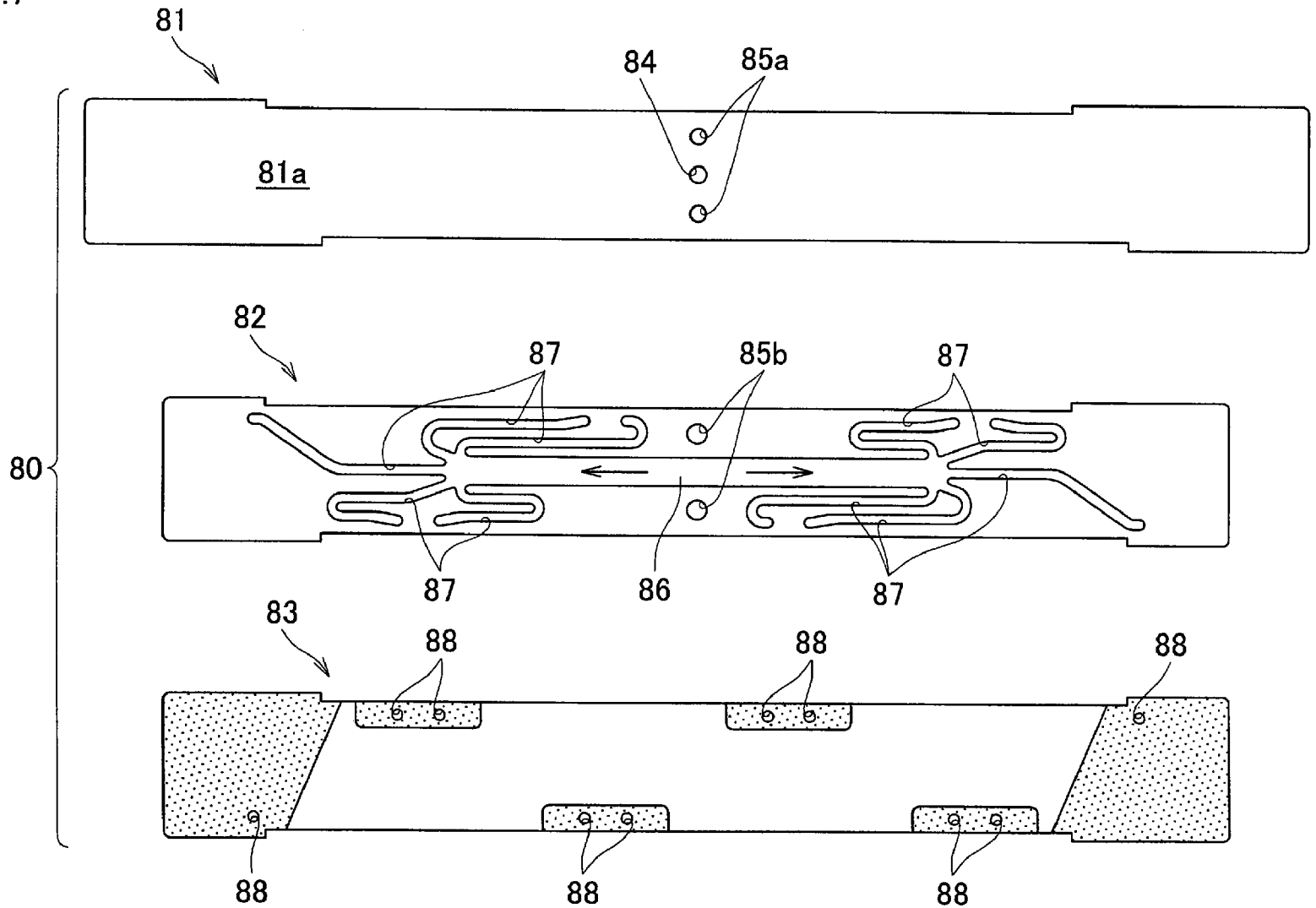
FIG. 7 is a plan view showing each of plates constituting an ink distribution component of a reservoir unit included in the ink-jet head of FIG. 1.

As shown in FIG. 7, the ink distribution component 80 includes an upper plate 81, a reservoir plate 82 and an under plate 83, all of which are made of metal, and has such a structure that the three metal plates 81, 82, 83 are piled on one another and adhesion-fixed to each other. Each of the plates 81 to 83 has a substantially rectangular shape elongated in the main scanning direction (refer to FIG. 1) and has a same width. The upper plate 81 has, as shown in FIG. 1, both longitudinal ends that protrude slightly beyond the other two plates 82, 83. This is for the purpose of fixing the head 1 to a holder (not shown) in the upper plate 31.

An inlet 84 into which the ink discharged from the outlet 72 is introduced is formed at a center of the upper plate 81. With respect to the sub scanning direction (refer to FIG. 1), first female screw holes 85*a* are symmetrically formed at both sides of the inlet 84. The diameter of each of the first female screw holes 85*a* is smaller than that of the through-holes 70*d* (refer to FIGS. 5A and 5B). All of the inlet 84 and the first female screw holes 85*a* are perforated in the thickness direction of the upper plate 81.

FIG. 7 is a plan view of the three plates 81 to 83 constituting the ink distribution component 80. In an upper part of FIG. 7, it is depicted an upper surface 81*a* that is a first surface of the upper plate 81, i.e. a surface of the upper plate 81 that contacts the lower surface 70*e* of the filter component 70. In a center part of FIG. 7, it is depicted an upper surface of the reservoir plate 82 adhered to the lower surface of the upper plate 81. In a lower part of FIG. 7, it is depicted a lower surface of the under plate 83 adhered to the upper surface of the passage unit 4. In other words, among the three plates 81 to 83, the lower surface is depicted only for the under plate 83.

The reservoir plate 82 is provided with holes so that the ink introduced from the inlet 84 is distributed to each of holes 88 formed in the under plate 83. The holes correspond to a main ink chamber 86 and branch passages 87 that are branched from the main ink chamber 86 and are perforated in the thickness direction. The main ink chamber 86 extends in both sides in the longitudinal direction (main scanning direction) of the reservoir plate 2 from a part confronting the inlet 84. The five branch passages 87 are branched from both ends of the main ink chamber 86, respectively. The main ink chamber 86 and the branch passages 87 are, as a whole, formed in a point symmetry manner about a center of the reservoir plate 82. The ink introduced from the inlet 84 is introduced to a center of the main ink chamber 86, then flows into right and left directions therefrom and is introduced into the respective branch passages 87.

In the reservoir plate 82, second female screw holes 85*b*, which are identical to each of the first female screw holes 85*a*, are formed at positions corresponding to the first female screw holes 85*a*. The two female screw holes 85*b* are disposed at both sides of the main ink chamber 86 while interposing the main ink chamber 86. The second female screw holes 86*b* are also perforated in the thickness direction of the reservoir plate 82.

The under plate 83 is formed with a total of ten perforated holes 88 each having a substantially circular shape. The holes are perforated in the under plate 83. Each of the holes 88 corresponds to the respective leading ends of the branch passages 87. In addition, the respective holes 88 correspond to each of openings 3*a* (refer to FIG. 8) of the passage unit 4. The ink introduced into the respective branch passages 87 from the main ink chamber 86 of the reservoir plate 82 is introduced into the holes 88 from the leading ends of the respective branch passages 87 and is supplied to the passage unit 4 through openings 3*a*.

The under plate 83 is such formed that only parts of oblique lines shown in FIG. 7 protrude downward by half etching. The under plate 83 is fixed to the passage unit 4 only at the parts of oblique lines. The fixing areas with the passage unit 4 are also areas in which the holes 88 are formed. The areas in which the holes 88 are formed are disposed near both edges of the width direction (sub scanning direction) of the under plate 83 in a zigzag pattern along the longitudinal direction (main scanning direction) of the under plate 83. In addition, the no-oblique line part forms a space between the upper surface of the passage unit 4 and it. The actuator units 21 are attached to the part corresponding to the space of the upper surface of the passage unit 4 (refer to FIGS. 2 and 8).

In the followings, the head main body 60 is described.

As shown in FIG. 1, the passage unit 4 has a substantially rectangular parallelepiped shape elongated in the main scanning direction. The size and shape of the passage unit 4 in plan view is approximately same as the respective components of the reservoir unit 90 except the upper plate 81. In the mean time, the combination of the passage unit 4 and the ink distribution component 80 constitutes the first passage component and the metal component of the present invention.

Figure 8:
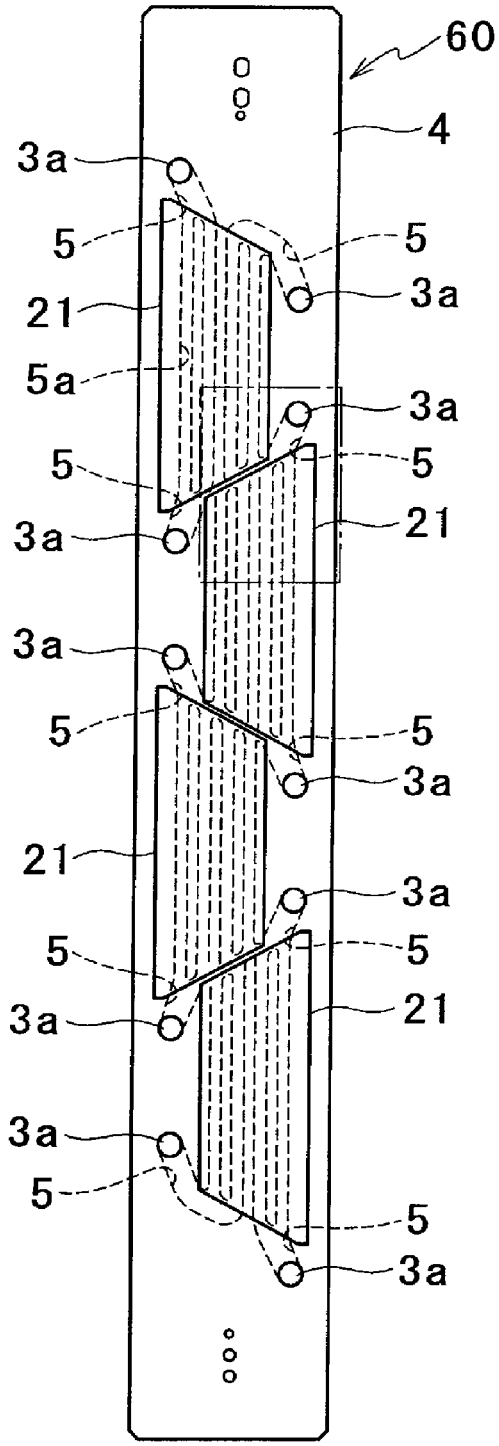
FIG. 8 is a plan view showing a head main body included in the ink-jet head of FIG. 1.
Figure 9:
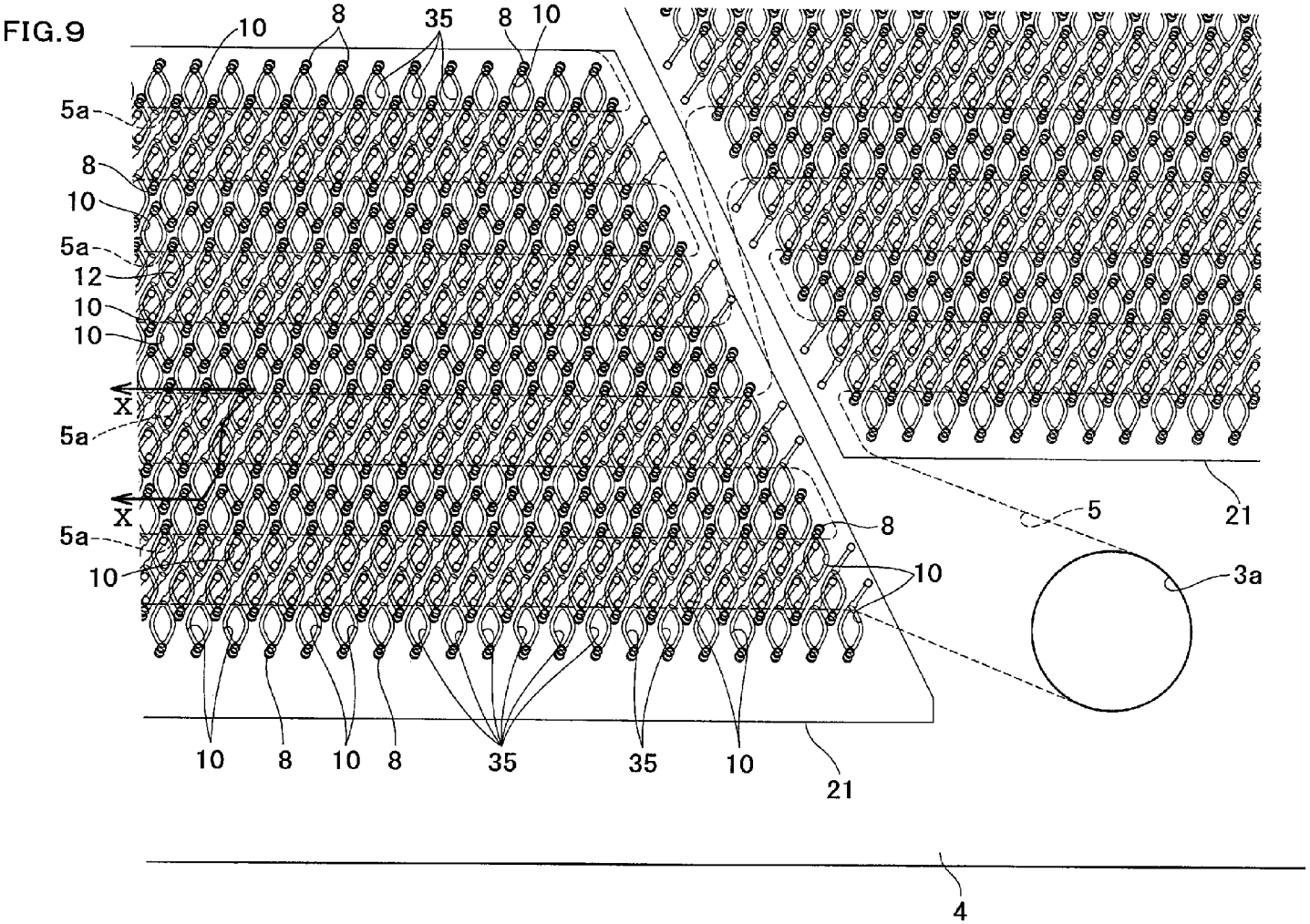
FIG. 9 is an enlarged view of a part surrounded by a dashed dotted line of FIG. 8.

FIG. 8 is a plan view of the head main body 60 and depicts the upper surface of the passage unit 4, i.e. the surface of the passage unit 4 adhered to the reservoir unit 90. FIG. 9 is an enlarged view of a part surrounded by a dashed dotted line of FIG. 8. In the mean time, in FIG. 9, for easy understanding of the drawing, the pressure chambers 10, the apertures 12 and the openings of the nozzles 8, i.e. ink ejection ports, that are below the actuator units 21 and are to be depicted by a broken line are indicated by a solid line.

As shown in FIG. 8, on the upper surface of the passage unit 4, two rows of openings 3*a* each row consisting of 5 openings, i.e. ten openings as a whole, are formed along the main scanning direction so that they avoid the actuator units 21. Manifold passages 5 communicating with each of the opening 3*a* are formed in the passage unit 4. Each of the manifold passages 5 is branched into several sub-manifold passages 5*a* extending in the main scanning direction. As shown in FIG. 9, the manifold passages 5 extend along the oblique sides of the actuator units 21. In the area interposed between the two actuator units 21, the single manifold passage 5 is shared by the neighboring actuator units 21 and the sub-manifold passages 5*a* are branched in the directions of the respective actuator units 21 from both sides of the manifold passages 5. As shown in FIG. 8, the four sub-manifold passages 5*a* are arranged in the part confronting the single actuator unit 21. The ink stored in the reservoir unit 90 is supplied to the manifold passages 5 and the sub-manifold passages 5*a* through the respective openings 3*a*.

Figure 10:
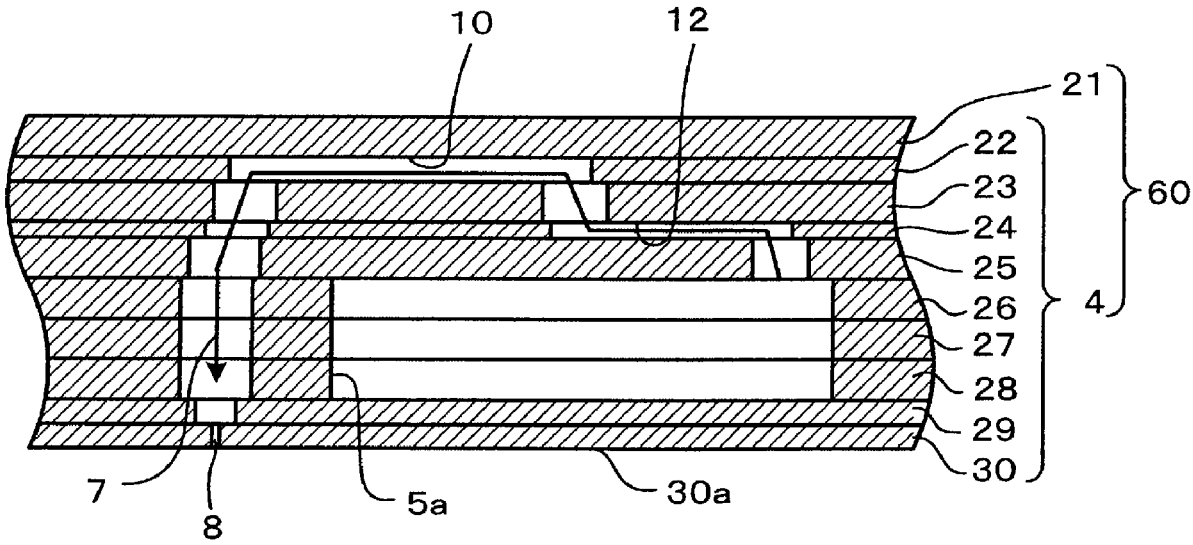
FIG. 10 is a sectional view taken along a line X-X of FIG. 9.

A number of nozzles 8 each having a minute diameter are arranged in matrix on the ink ejection face 30 that is a lower surface of the passage unit 4 corresponding to adhering areas of the respective actuator units 21 (refer to FIGS. 9 and 10). The pressure chambers 10 corresponding to the respective nozzles 8 are arranged in matrix in the adhering areas of the actuator units 21 on the upper surface of the passage unit 4. Each of the pressure chambers 10 is substantially rhombic in plan view. In this embodiment, the pressure chambers 10 are disposed to forms rows at an equal interval along the longitudinal direction of the passage unit 4. The rows of the pressure chambers 10 that are total 16 rows are arranged in parallel with each other in the adhering area of one actuator unit 21. The nozzles 8 are also disposed in the same manner as the pressure chambers 10 and capable of forming an image with a resolution of 600 dpi, as a whole.

A number of individual ink passages 7 (refer to FIG. 10), which are formed from outlets of the sub-manifold passages 5*a* to the nozzles 8 via the apertures 12 and the pressure chambers 10, are connected to the respective sub-manifold passages 5*a*. The individual ink passages 7 are formed for each of the nozzles 8.

The four actuator units 21 have a trapezoidal shape in plan view, respectively, and are arranged in a zigzag form on the upper surface of the passage unit 4 so that upper bases and lower bases thereof are directed to the main scanning direction. The respective actuator units 21 are adhered to the passage unit 4 with an epoxy-based thermosetting adhesive, and are arranged so that they confront a bottom surface of the recessed part (no-oblique line part) of the under plate 83 shown in the lower part of FIG. 7 while forming a gap with the bottom surface. The oblique sides of the neighboring actuator units 21 are overlapped with each other with respect to the sub scanning direction.

On the upper surfaces of the actuator units 21, individual electrodes 35 slightly smaller than the pressure chambers 10 are respectively provided at positions corresponding to the respective pressure chambers 10 (refer to FIG. 9). Each of the actuator units 21 is connected with a flexible printed circuit board (not shown). Based on a driving signal transmitted through the corresponding flexible printed circuit board, it is controlled potentials between the respective individual electrodes 35 and common electrodes (not shown) formed over the entire areas of the actuator units 21. By such control, sections of the actuator units 21 where the individual electrodes 35 are provided are selectively deformed, so that ejection energy is applied to the ink in the corresponding pressure chambers 10, thereby the ink in the corresponding pressure chambers 10 is ejected from the nozzles 8.

FIG. 10 is a sectional view taken along a line X-X of FIG. 9 and shows a sectional structure of a unit device for ejecting the ink.

As shown in FIG. 10, the passage unit 4 consists of nine laminated plates of a cavity plate 22, a base plate 23, an aperture plate 24, a supply plate 25, manifold plates 26, 27, 28, a cover plate 29 and a nozzle plate 30 which are metal plates composed of SUS430, for example, and are adhesion-fixed with each other.

The cavity plate 22 has a number of substantially rhombic through-holes corresponding to the pressure chambers 10. The base plate 23 has a number of through-holes for communicating the respective pressure chambers 10 and the apertures 12 with each other and a number of through-holes for communicating the respective pressure chambers 10 and the nozzles 8 with each other. The aperture plate 24 has a number of through-holes corresponding to the apertures 12, and a number of through-holes for communicating the respective pressure chambers 10 and the nozzles 8 with each other. The supply plate 25 has a number of through-holes for communicating the respective apertures 12 and the sub-manifold passages 5*a* with each other and a number of through-holes for communicating the respective pressure chambers 10 and the nozzles 8 with each other. Each of the three manifold plates 26, 27, and 28 has the sub-manifold passages 5*a* and a number of through-holes for communicating the respective pressure chambers 10 and the nozzles 8 with each other. The cover plate 29 has a number of through-holes for communicating the respective pressure chambers 10 and the nozzles 8 with each other. The nozzle plate 30 has a number of nozzles 8.

The plates 22 to 30 are laminated, being lined up with each other to thereby form the individual ink passages 7 shown in FIG. 10. The individual ink passages 7 are a passage that is directed upward from the sub-manifold passages 5*a*, extends horizontally in the apertures 12, is again directed upward therefrom, extends horizontally again in the pressure chambers 10, is obliquely directed downward therefrom in a direction away from the apertures 12 and is then directed vertically to the nozzles 8.

As shown in FIG. 10, with respect to the laminated direction of the plates 22 to 30, the pressure chambers 10 and the apertures 12 are provided in different levels from each other. Thereby, as shown in FIG. 9, the aperture 12 communicating with one pressure chamber 10 can be disposed to be overlapped with another pressure chamber 10 adjacent to the corresponding pressure chamber 10, in plan view. As a result, it is possible to dispose the pressure chambers 10 in a high density and to achieve downsizing of the ink-jet head 1 and a high-resolution printing.

As described above, according to the ink-jet head 1 of this embodiment, during the screwing process of the stepped screws 91, the convexes 70*b* of the filter component 70 of the reservoir unit 90 are pressed at the heads 91*a* of the stepped screws 91, so that they are deformed as shown in FIG. 5B. In addition, the gaps between the leading ends of the cylinder parts 91*b* and the upper surface 81*a* of the upper plate 81 disappear, so that the screwing process of the stepped screws 91 is terminated when the corresponding leading ends and the upper surface 81*a* are press-contacted to each other. At this time, the force of the direction opposite to the screwing direction, i.e. upward force is applied to the heads 91*a* of the stepped screws 91 from the deformed convexes 70*b*, and the reaction to the upward force is applied to the convexes 70*b* from the heads 91 of the stepped screws 91. Through the action-reaction of the force, the stepped screws 91 are securely fixed to the filter component 70 and the ink distribution component 80, so that the state when the screwing termination can be maintained. In other words, the filter component 70 and the ink distribution component 80 are firmly fixed without being dislocated from each other, thereby maintaining the fixed state. In such structure, even when there occurs a change in environmental temperature, it does not influence on the fixed state of the stepped screws 91, so that it is possible to maintain the fixation between the filter component 70 and the ink distribution component 80.

Furthermore, the heat expansions of the two components influence on the fixed state of the filter component 70 and the ink distribution component 80. But the fixed state of the stepped screws 91 is always maintained without being influenced depending on the fixed states between the filter component 70 and the ink distribution component 80. Therefore, the problem that the ink is leaked from the connection part between the filter component 70 and the ink distribution component 80 is suppressed, so that it is possible to supply the ink to the nozzles 8 smoothly.

Since the convexes 70*b* are integrally formed with the filter component 70, it is possible to decrease the number of parts, as compared to a case where a separate component is provided as the convexes 70.

The O-rings 77 (refer to FIGS. 2 and 4) are disposed with being elastically deformed at the positions surrounding the outlet 72 of the lower surface 70*e* of the filter component 70 which are positions surrounding the inlet 84 of the upper surface 81*a* of the upper plate 81 of the ink distribution component 80. Therefore, it is possible to efficiently prevent the ink leakage from the inlet 84. Specifically, even when there is a slight gap between the lower surface 70*e* of the filter component 70 and the upper surface 81*a* of the upper plate 81, it is possible to prevent the ink, which passes to the outlet 72 and the inlet 84, from being leaked through the corresponding gap by the sealing effect of the O-rings 77.

As shown in FIG. 4, the portions of the O-rings 77 are disposed at the areas confronting the heads 91*a* with respect to the axial direction of the cylinder parts 91*b* of the stepped screws 91, i.e. the direction perpendicular to the sheet of FIG. 4. In this case, as the stepped screws 91 are tightened, the force is directly applied to the O-rings 77 also, thereby improving the sealing effect. Accordingly, it is possible to prevent the ink leakage from the inlet 84, more effectively.

The two stepped screws 91 are provided so as to fix the filter component 70 and the ink distribution component 80 each other, a portion of the O-ring 77 is disposed at the area confronting the head 91*a* of the one stepped screw 91 with respect to the axial direction of the cylinder parts 91*b* of the stepped screws 91, i.e. the second confronting area, and another portion of the O-ring 77 is disposed at the area confronting the head 91*a* of the other stepped screw 91 with respect to the axial direction, i.e. the third confronting area. In this case, since the force is applied to the O-rings 77 by the two stepped screws 91, the sealing effect is further improved, so that it is possible to prevent the ink leakage from the inlet 84, more effectively.

Furthermore, the centers of the two stepped screws 91 are symmetrically disposed about the center axis of the inlet 84, in plan view. Thereby, since the vicinity of the inlet 84 is more firmly fixed by the two stepped screws 91 and the O-rings 77 are symmetrically pressed, the sealing effect is further improved, so that it is possible to prevent the ink leakage from the inlet 84, more effectively.

Furthermore, this embodiment has followings effects, as compared to a case where a screw (referred to as "typical screw") having a head and a male screw part and having no cylinder part is used instead of the stepped screws 91. For example, the through-hole 70*d* shown in FIG. 5A is made to be same as the diameters of the first and second female screw holes 85*a*, 85*b* and is threaded. The male screw part of the typical screw is inserted into the through-hole 70*d* and the first and second female screw holes 85*a*, 85*b* and the convexes 70*b* are pressed and deformed at the head. After such screwing process, when there occurs a difference of heat expansions between the components or vibration, because the typical screw is directly connected to the head without the cylinder part, the difference of heat expansions or vibration influences on the screw-engagement part of the male screw part, so that the screws are easily disengaged and the head is spaced apart from the convexes 70*b*. When the head is spaced apart from the convexes 70*b*, the engagement by the screw is loosened and the fixation between the filter component 70 and the ink distribution component 80 is not maintained, so that the ink is leaked from the connection part of the two components. To the contrary, when the stepped screws 91 are used as this embodiment, even when there occurs the difference of heat expansions between the components or vibration, since the male screw part 91*c* is connected to the head 91*a* through the cylinder part 91*b*, the difference of heat expansions or vibration does not influence on the screw-engagement part of the male screw part 91*c*, so that it is suppressed to occur the disengagement of the screws, thereby reducing the above problem.

In the above embodiment, the convexes 70*b* are integrally formed with the filter component 70. However, the present invention is not limited thereto. For example, it may be provided convexes which are separate components composed of materials capable of being deformed by the pressing force.

The convexes 70*b* are not limited to the structure in which they are annularly formed along the edges of the through-holes 70*d*. For example, the convexes having a polygonal shape may be provided. Alternatively, several convexes may be discretely formed.

In the above embodiment, the portions of the O-rings 77 are disposed at the areas confronting the heads 91*a* with respect to the axial direction of the cylinder parts 91*b* of the stepped screws 91. However, the present invention is not limited thereto. Further, the O-rings 77 may be omitted.

In the above embodiment, the two stepped screws 91 are used. However, only a single stepped screw or three or more stepped screws 91 may be used. Alternatively, the centers of the two stepped screws 91 may not be symmetrically disposed about the center axis of the inlet 84.

The positions for attaching the stepped screws 91 are not limited to the vicinity of the outlet 72.

Figure 11A:
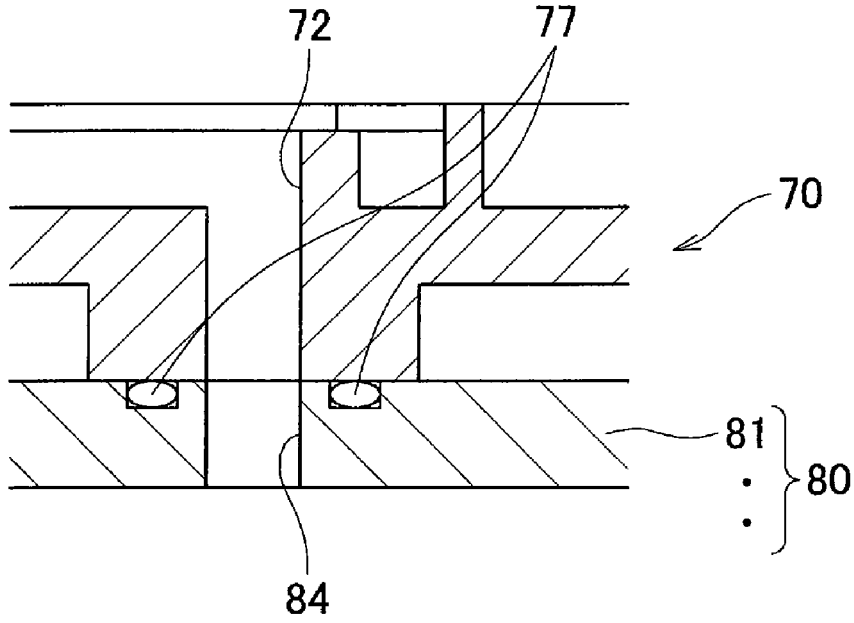
FIG. 11A is a sectional view showing a modification to a disposal of O-rings.
Figure 11B:
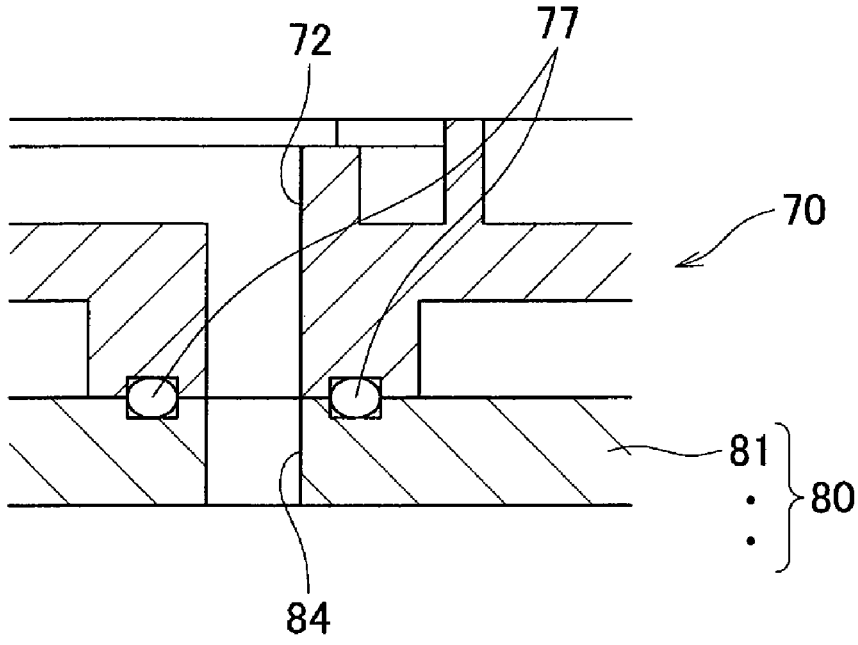
FIG. 11B is a sectional view showing another modification to a disposal of O-rings.

In the above embodiment, the O-rings 77 are provided in the recesses 77*a* formed on the lower surface 70*e* of the filter component 70. However, as shown in FIG. 11A, the recesses may be formed at positions surrounding the inlet 84 of the upper surface 81*a* of the upper plate 81 of the ink distribution component 80 and the O-rings 77 may be provided in the corresponding recesses. In addition, as shown in FIG. 11B, the recesses may be formed at both the lower surface 70*e* of the filter component 70 and the upper surface 81*a* of the upper plate 81 while confronting each other and the O-rings 77 may be provided in the corresponding recesses. In any cases, the water-tight state between the outlet 72 of the filter component 70 and the inlet 84 of the ink distribution component 80 is maintained by the O-rings 77.

When the uppermost plate 81 of the three plates 81 to 83 included in the ink distribution component 80 is composed of metal, the other plates 82,83 may be composed of materials except the metal. In other words, when the surface of the ink distribution component 80, contacting the filter component 70 made of resin, is composed of metal, the connection structure of the present invention can be applied.

As long as the surface of the filter component 70 contacting the ink distribution component 80 is formed with the outlet through which the ink to be supplied to the ink distribution component 80 is discharged, and the surface of the ink distribution component 80 contacting the filter component 70 is formed with the inlet into which the ink discharged through the outlet is introduced, the structure of the ink passages in the reservoir unit 90 is not limited to the above embodiment and may be variously modified.

In the above embodiment, the upper plate 81 and the reservoir plate 82 are respectively formed with the first and second female screw holes 85*a*, 85*b* with which the male screw parts 91*c* of the stepped screws 91 are engaged. However, the present invention is not limited thereto. For example, only the upper plate 81 may be formed with a female screw hole or the under plate 83 may be also formed with a female screw hole.

The actuator units 21 are not limited to the piezoelectric type. For example, a variety of driving modes such as thermal type may be adopted.

The present invention is not limited to an ink-jet head and may be applied to a structure that the resin component and the metal component of various apparatuses are connected, in addition to the ink-jet head.

While this invention has been described in conjunction with the specific embodiments outlined above, it is evident that many alternatives, modifications and variations will be apparent to those skilled in the art. Accordingly, the preferred embodiments of the present invention as set forth above are intended to be illustrative, not limiting. Various changes may be made without departing from the spirit and scope of the present invention as defined in the following claims.

What is claimed is:

1. An ink-jet head comprising:

a first passage component having an ink ejection face in which ink ejection ports for ejecting ink are formed and a first surface opposite to the ink ejection face and composed of metal;

a second passage component composed of resin and having a second surface contacting the first surface of the first passage component and a third surface opposite to the second surface, the second surface having an outlet through which the ink to be supplied to the first passage component is discharged; and a screw that fixes the first passage component and the second passage component each other, wherein the second passage component is formed with a through-hole connecting the second surface and the third surface, wherein the first surface of the first passage component is formed with a female screw hole smaller in diameter than the through-hole and an inlet into which the ink discharged through the outlet is introduced, wherein the screw is a stepped screw having a head larger in diameter than that of the through-hole, a cylinder part connected to the head and having a diameter capable of being inserted into the through-hole, and a male screw part extending from the leading end of the cylinder part in the axial direction of the cylinder part and having a diameter smaller than the through-hole, wherein the first passage component and the second passage component are fixed with each other as the male screw part is screw-engaged with the female screw hole while the cylinder part of the stepped screw is inserted into the through-hole, wherein the second passage component has a convex contacting the head and a spaced surface spaced apart from the head in the axial direction, both in a first annular confronting area confronting the head of the stepped screw, with respect to the axial direction, at a surrounding of the through-hole of the third surface, and wherein the axial length of the cylinder part is same as the length of a line segment extending to the second surface from the leading end of the convex in the axial direction, while the axial length of the cylinder part is smaller than the length of the line segment until the male screw part is screw-engaged with the female screw hole.

2. The ink-jet head according to claim 1, wherein the convex is integrally formed with the second passage component.

3. The ink-jet head according to claim 1, further comprising an annular elastic component that is disposed with being elastically deformed at one of a position surrounding the inlet of the first surface and a position surrounding the outlet of the second surface.

4. The ink-jet head according to claim 3, wherein a portion of the annular elastic component is disposed at a second confronting area confronting the head of the stepped screw, with respect to the axial direction, in the second surface.

5. The ink-jet head according to claim 4, wherein the two stepped screws that fix the first passage component and the second passage component are provided, wherein the portion of the elastic component is disposed at the second confronting area confronting the head of the one stepped screw, with respect to the axial direction, in the second surface, and another portion of the elastic component is disposed at a third confronting area confronting the head of the other stepped screw, with respect to the axial direction, in the second surface.

6. The ink-jet head according to claim 5, wherein centers of the two stepped screws are symmetrically disposed, in plan view, about the center axis of the inlet.

7. A connection structure between a resin component and a metal component using a screw, wherein the metal component has a first surface contacting the resin component, wherein the resin component has a second surface contacting the first surface of the metal component and a third surface opposite to the second surface, wherein the resin component is formed with a through-hole connecting the second surface and the third surface, wherein the first surface of the metal component is formed with a female screw hole smaller in diameter than the through-hole, wherein the screw is a stepped screw having a head larger in diameter than that of the through-hole, a cylinder part connected to the head and having a diameter capable of being inserted into the through-hole, and a male screw part extending from the leading end of the cylinder part in the axial direction of the cylinder part and having a diameter smaller than the through-hole, wherein the resin component and the metal component are fixed with each other as the male screw part is screw-engaged with the female screw hole while the cylinder part of the stepped screw is inserted into the through-hole, wherein the resin component has a convex contacting the head and a spaced surface spaced apart from the head in the axial direction, both in an annular confronting area confronting the head of the stepped screw, with respect to the axial direction, at a surrounding of the through-hole of the third surface, and wherein the axial length of the cylinder part is same as the length of a line segment extending to the second surface from a leading end of the convex in the axial direction, while the axial length of the cylinder part is smaller than the length of the line segment until the male screw part is screw-engaged with the female screw hole.

8. The connection structure according to claim 7, wherein the convex is integrally formed with the resin component.

* * * * *